United States Patent [19]

Anderson

[11] 3,987,749

[45] Oct. 26, 1976

[54] MOBILE PEDAL PROPULSION FOR SMALL BOATS

[76] Inventor: Axel J. Anderson, 5155 Langelier Blvd., Montreal H1M 2A3, Quebec, Canada

[22] Filed: Aug. 25, 1975

[21] Appl. No.: 607,827

[52] U.S. Cl. ..... 115/25; 115/24

[51] Int. Cl.[2] ..... B63H 16/12

[58] Field of Search ..... 115/21, 24, 26, 25, 115/2

[56] References Cited

UNITED STATES PATENTS

| | | | |
|---|---|---|---|
| 2,099,544 | 11/1937 | Strezoff | 115/24 |
| 2,420,422 | 5/1947 | Gilliam | 115/25 |
| 2,646,765 | 7/1953 | Boles | 115/26 |

*Primary Examiner*—Trygve M. Blix
*Assistant Examiner*—Sherman D. Basinger

[57] ABSTRACT

A pedal boat which distinctively includes a pedal propulsion unit which is removable to dispose of any downward projection at the bottom of the boat shell and thus allows taking the boat in very shallow water and ashore, like a conventional row-boat. Removal of the pedal propulsion unit also allows conversion of the pedal-boat to a row-boat. This pedal-boat includes a boat shell with an aperture in the bottom, a closed perimeter wall upstanding from the bottom in sealed engagement therewith, in circumscribing relationship with the aperture through the bottom, and laterally confining a well space inside the boat shell, and a pedal propulsion unit removably mountable in the well space and including a watertight enclosure fitting in the well space, pedals projecting from opposite sides of the enclosure, a saddle projecting upwardly from the latter, and an impeller and a rudder projecting downwardly below the bottom of the boat through the aperture in the latter.

1 Claim, 4 Drawing Figures

MOBILE PEDAL PROPULSION FOR SMALL BOATS

This invention relates to a pedal-boat.

The pedal-boats which have been proposed or made so far include a paddle wheel, pedals and an appropriate chain or belt drive connecting the latter to the paddle wheel with all these elements dispersed and separately connected to the hull or shell of the boat in a permanent manner. There results a boat which can be used solely as a pedal-boat and which, because of the paddle wheel and rudder, cannot be taken to the shallowest waters without risks of damage thereto.

It is a general object of the present invention to provide a pedal-boat which avoids the above-mentioned limitations and which is of more universal use than a conventional pedal-boat.

It is a more specific object of the present invention to provide a pedal-boat with a removable pedal propulsion unit which may be selectively removed either for shallow water use of the boat or for conversion of the latter for use as a row-boat.

The above and other objects and advantages of the present invention will be better understood with the following detailed description of a preferred embodiment thereof, which is illustrated, by way of example, in the accompanying drawings, in which.

The pedal-boat according to the present invention includes a boat shell or hull having the conventional outline of a row-boat and including a bottom 1, a port side 12 and a starboard side 3.

Figure 1:
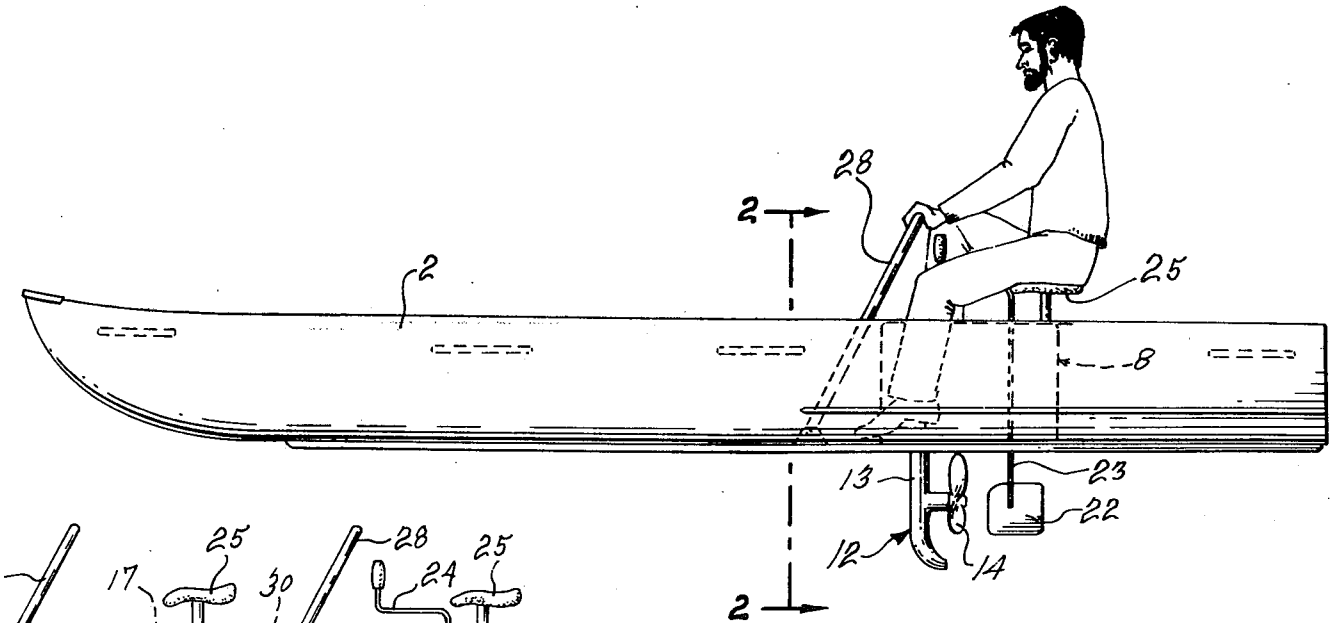
FIG. 1 is a side elevation view of a pedal-boat and user according to a first embodiment of the present invention.
Figure 3:
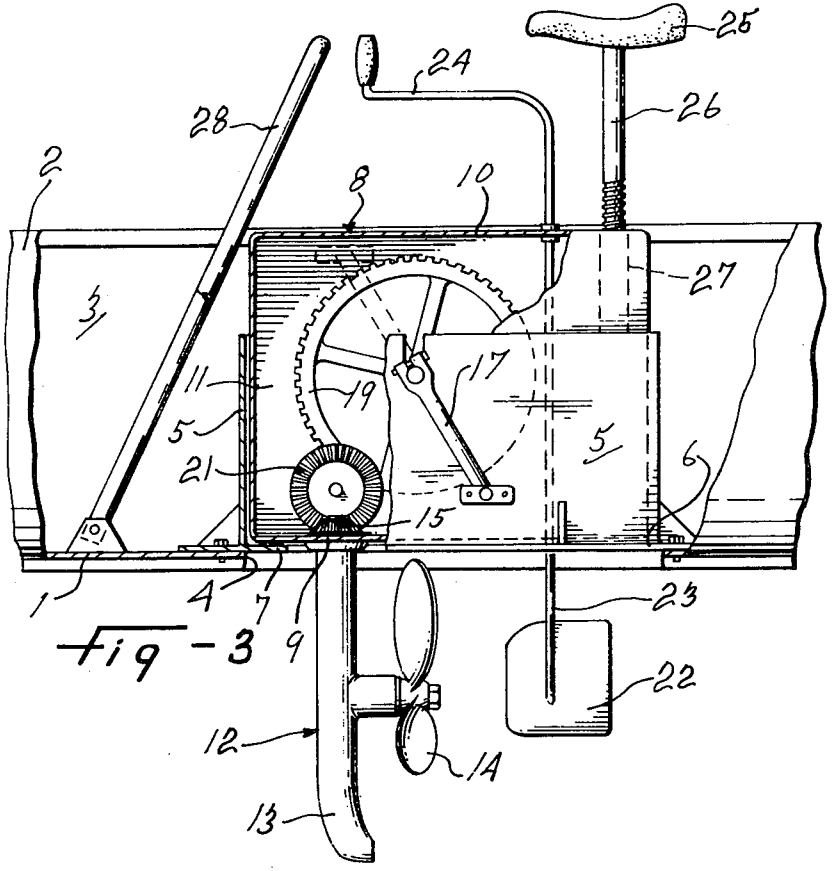
FIG. 3 is an enlarged scale partial view of FIG. 1, with parts broken away to particularly illustrate the removable pedal propulsion unit in operative position in the boat.
Figure 2:
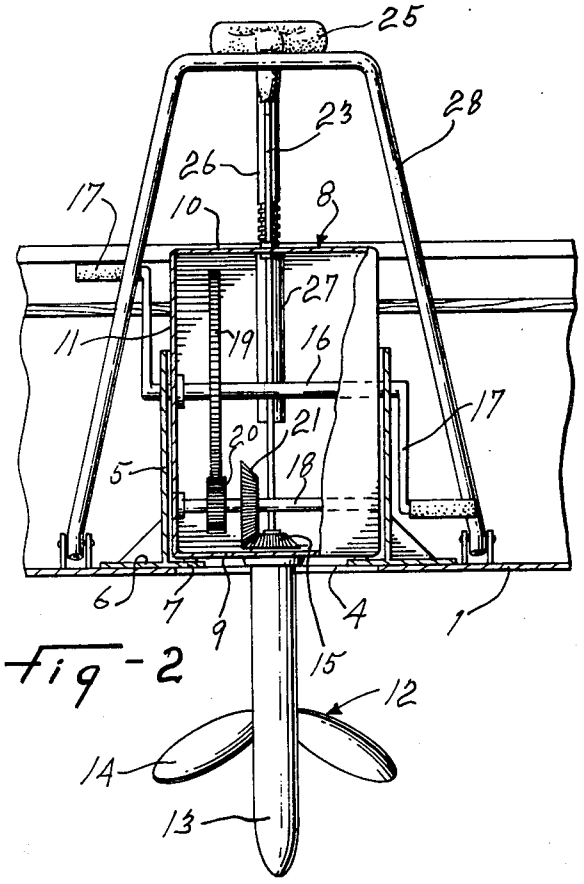
FIG. 2 is a transverse cross-sectional view as seen along line 2—2 in FIG. 1.

In the embodiment of FIGS. 1, 2 and 3, the bottom 1 is formed with an aperture 4. A wall 5 forming a closed perimeter extends upwardly from the bottom 1 in sealed engagement with the latter between the port and starboard sides and in circumscribing relationship with the aperture 4. The closed perimeter wall 5 confines a well space inside the boat shell and is formed at the bottom with an outer flange 6 and an inner flange 7. The outer flange 6 is secured onto the edge of the aperture 4 and is sealed to the bottom 1 to form a fluid-tight joint with the latter. The inner flange 7 is provided to form a rest for a pedal propulsion unit.

The pedal propulsion unit, particularly illustrated in FIGS. 2 and 3, includes a watertight enclosure 8 having a bottom 9, a top 10 and opposite sides 11. A water propulsion device 12 projects downwardly from the bottom 9 and includes a column 13, an impeller 14 and a conventional drive in the column 13 for the impeller 14. A bevel gear 15 is connected to the drive in the column 13.

A crank 16 transversely extends through the watertight enclosure 8 and terminates at the opposite ends by a pair of pedals 17 projecting from opposite sides 11 of the enclosure. An intermediate shaft 18 extends transversely in the enclosure 8 and is secured for rotation parallel to the crank 16. A pair of gears 19 and 20 are secured to the crank 16 and to the intermediate shaft 18 to transmit rotation of the pedals to the latter. A pinion gear 21 is fixed to the intermediate shaft 18 in meshing engagement with the bevel gear 15 to transmit rotation to the impeller 15.

A rudder 22 is positioned under the bottom of the watertight enclosure 8 and is fixed to a control rod 23 which extends upwardly through this enclosure and is bent at its upper end to form a crank 24 to provide sufficient leverage to easily rotate the rudder 22. The latter is positioned behind the impeller 14 to take advantage of the slipstream of the latter.

A saddle 25 is adjustably mounted above the enclosure 8 by a threaded post 26 screwing in a complementarily threaded sleeve 27 rigidly held upright in the enclosure. A tubular handgrip 28 is mounted in front of the pedal propulsion unit. This handgrip is U-shaped with its opposite ends adjustably securable tight at the desired position.

Figure 4:
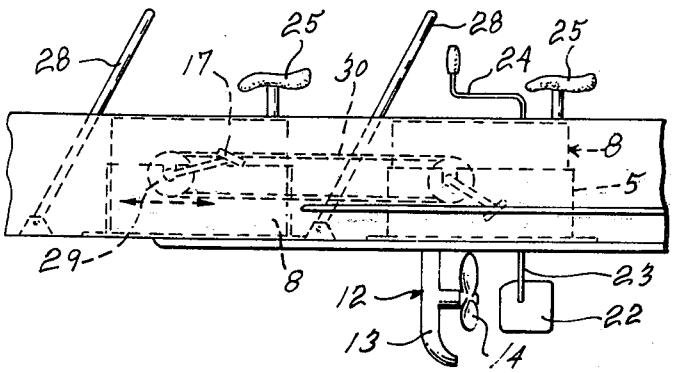
FIG. 4 is a partial side view of a pedal-boat according to a second embodiment of the present invention.

As shown in FIGS. 1, 2, and 3, the pedal boat according to the present invention may be provided with a single pedal propulsion unit but it may as well be provided with many pedal propulsion units. For instance, the embodiment of FIG. 4 shows a tandem arrangement including a rear pedal propulsion unit, as shown and described with reference to FIGS. 1, 2, and 3, and also including a front pedal propulsion unit. The latter is a simplified version of the pedal propulsion unit of FIGS. 1, 2, and 3, since it has no water propulsion device, no gear and no rudder; but it includes the pedals 17, the saddle 25, and the watertight enclosure 8 held within a closed perimeter wall 5. A sprocket wheel 29 is connected to the pedals 17 and a chain 30 connects the sprocket wheel 29 to a similar sprocket wheel added to the crank 16 of the rear unit. It must be noted that this chain and associated sprockets are positioned externally of both closed perimeter walls 5. The bottom of the boat needs no aperture underneath the afore-described front pedal propulsion unit and, therefore, the associated closed perimeter wall 5 does not surround an aperture.

In normal operation as a pedal-boat, the pedal propulsion units are lowered in position into the well space defined by the corresponding walls 5 and need no fixing, since the weight of the users is sufficient to keep them down. In shallow water, the units are pulled out and the boat behaves like a row-boat and may be dragged without damage right onto the shore.

The pedal boat according to the present invention may be used without pedal propulsion unit, as a row-boat, in which case, the fisherman may drop his line through the aperture in the bottom.

The tandem arrangement shown in FIG. 4 may be used as a rescue boat or a passenger boat.

What I claim is:

1. A pedal-propelled boat comprising a boat shell defining a bottom and sides, said bottom having an aperture, a closed perimeter wall forming a well open at both ends, upstanding from said bottom and having an outwardly directed bottom flange secured in fluid-tight relation to the edge of said aperture, and an inwardly directed bottom flange to form a rest for a pedal-operated propelling unit, said closed perimeter wall spaced from the sides of said boat shell and having a top edge at a higher level than the normal level of floatation of the boat shell, and a pedal-operated boat propelling unit removably fitted within said well, said unit including a watertight enclosure having a bottom wall resting on said bottom flange, side walls closely fitting said closed perimeter wall and a top wall higher than the top edge of said closed perimeter wall, a column secured to and projecting downwardly through said aperture from said enclosure bottom wall, an impeller rotatably carried by said column under said boat shell bottom, a crank shaft extending transversely through said enclosure and projecting through opposite side walls thereof and transversely of the boat shell and extending over the top edge of said closed perimeter wall beyond the latter into the spaces between said well and said boat shell sides, pedals carried by the ends of said crank shaft, and located in said spaces, gear means located in said enclosure and drivingly connecting said crank shaft and said impeller for rotating said impeller by rotating said crank shaft by means of said pedals, a rudder located under said enclosure bottom wall behind said impeller and secured to the lower end of a control rod rotatably journalled in said enclosure and extending upwardly through said enclosure above the same, a rudder control means secured to the upper end of said control rod, and a saddle carried by the top of said enclosure above the same in a position such that a person seated on the saddle has access to said pedals and to said rudder control means, said enclosure being removable from said boat shell as a unit including said saddle, said enclosure, said impeller and said rudder, said aperture being of a size sufficient to allow passage of said impeller and rudder therethrough.

* * * * *